US011187437B2

(12) United States Patent
Sun et al.

(10) Patent No.: US 11,187,437 B2
(45) Date of Patent: Nov. 30, 2021

(54) COOLING SYSTEM

(71) Applicant: Heatcraft Refrigeration Products LLC, Stone Mountain, GA (US)

(72) Inventors: Xi Sun, Snellville, GA (US); Shitong Zha, Snellville, GA (US)

(73) Assignee: Heatcraft Refrigeration Products LLC, Stone Mountain, GA (US)

( * ) Notice: Subject to any disclaimer, the term of this patent is extended or adjusted under 35 U.S.C. 154(b) by 347 days.

(21) Appl. No.: 16/243,675

(22) Filed: Jan. 9, 2019

(65) Prior Publication Data

US 2020/0217562 A1 Jul. 9, 2020

(51) Int. Cl.
*F25B 1/10* (2006.01)
*F25B 43/00* (2006.01)

(52) U.S. Cl.
CPC ..... *F25B 1/10* (2013.01); *F25B 43/006* (2013.01); *F25B 2400/075* (2013.01); *F25B 2400/13* (2013.01); *F25B 2400/23* (2013.01)

(58) Field of Classification Search
CPC .. F25B 2400/23; F25B 2400/075; F25B 5/02; F25B 1/10; F25B 2400/14
See application file for complete search history.

(56) References Cited

U.S. PATENT DOCUMENTS 5,174,123 A * 12/1992 Erickson ..... F25B 1/047 62/113
5,467,613 A * 11/1995 Brasz ..... F03B 13/00 417/405
9,689,590 B2 * 6/2017 Christensen ..... F25B 9/008
9,726,411 B2 * 8/2017 Zimmermann ..... F25B 1/10
2007/0068178 A1 * 3/2007 Honma ..... F25B 49/02 62/160
2012/0167601 A1 * 7/2012 Cogswell ..... F25B 1/10 62/115
2014/0157750 A1 * 6/2014 Landi ..... F01D 25/20 60/39.08
2018/0283755 A1 * 10/2018 Zhao ..... F25B 49/02

FOREIGN PATENT DOCUMENTS

EP 2482003 A1 8/2012
JP 2012042110 A * 3/2012
JP 2012042110 A 3/2012

OTHER PUBLICATIONS

European Patent Office, Extended Search Report, Application No. 19218758.1, dated Jun. 2, 2020, 6 pages.

(Continued)

*Primary Examiner* — Frantz F Jules
*Assistant Examiner* — Lionel Nouketcha
(74) *Attorney, Agent, or Firm* — Baker Botts L.L.P.

(57) ABSTRACT

An apparatus includes a first expander, a flash tank, a first load, a first work recovery compressor, a valve, and a first compressor. The first expander expands a refrigerant. The flash tank stores a refrigerant from the expander. The first load uses the refrigerant from the flash tank to cool a space proximate the first load. The work recovery compressor compresses the refrigerant from the first load and is driven by the first expander. The valve reduces the pressure of the refrigerant from the work recovery compressor below a threshold. The first compressor compresses the refrigerant from the valve.

17 Claims, 5 Drawing Sheets

(56) References Cited

OTHER PUBLICATIONS

Hans-Joachim Huff, Reinhard Radermacher; $CO_2$ Compressor-Expander Analysis; prepared for the Air-Conditioning and Refrigeration Technology Institute; Arlington, VA 22208; ARTI-21CR/611-10060-01; 77 pages.
Josef Riha, et al.; Sub-Critical Operation of the CO2 Expander/Compressor; International Compressor Engineering Conference (Jul. 17-20, 2006); Purdue University Purdue e-Pubs; 8 pages.
Zhang, Bo, et al.; Design and Experimental Validation of the slider-Based Free Piston Expander for Transcritical $CO_2$ Refrigeration Cycle; National Engineering Research Center for Fluid Machinery and Compressors; 8 pages.

* cited by examiner

COOLING SYSTEM

TECHNICAL FIELD

This disclosure relates generally to a cooling system, such as a refrigeration system.

BACKGROUND

Cooling systems are used to cool spaces, such as residential dwellings, commercial buildings, and/or refrigeration units. These systems cycle a refrigerant that is used to cool the spaces. As the refrigerant cycles, it is expanded and releases energy. This energy can be returned to the system to increase system efficiency.

SUMMARY OF THE DISCLOSURE

Refrigeration systems cycle refrigerant to cool spaces, such as residential dwellings, commercial buildings, and/or refrigeration units. Typical refrigeration systems include flash tanks, loads, compressors, and a high side heat exchanger. The flash tank stores refrigerant, which is first cycled through the loads. The loads use the refrigerant to cool a space proximate the loads by absorbing heat. Thus, the refrigerant leaving the loads is warmer than the refrigerant entering the loads. The refrigerant is then directed to the compressors. The compressors compress the refrigerant to concentrate the absorbed heat so that the high side heat exchanger can more easily remove the heat from the refrigerant. The refrigerant next cycles through the high side heat exchanger, which removes heat from the refrigerant. From the high side heat exchanger, the refrigerant cycles back to the flash tank, and the cycle begins again.

Some commercial refrigeration systems also include an expander that receives refrigerant from the high side heat exchanger before directing the refrigerant to the flash tank. In these systems, the expander further cools the refrigerant through expansion, so the refrigerant is colder when it reaches the loads. During expansion, the refrigerant releases energy that is captured by the expander. These systems, however, are unable to use the energy released during expansion. Thus, the energy is simply lost. On the other hand, some systems use the energy released during expansion to drive a work recovery compressor that compresses the refrigerant coming from one or more loads before the refrigerant reaches the compressors. As a result, the heat that has been absorbed by the refrigerant in the loads is more concentrated and can be more easily removed by the high side heat exchanger. However, this process can become unstable depending on ambient temperature. If the ambient temperature is too high, the pressure of the system can reach dangerous levels. Thus, there is a need to stabilize the pressure of the refrigerant from the work recovery compressor before returning it to the system.

This disclosure contemplates an unconventional cooling system that uses energy released during expansion to drive a work recovery compressor. The work recovery compressor compress refrigerant from a load, thus concentrating heat. This disclosure also contemplates using a valve to stabilize the pressure of the refrigerant from the work recovery compressor before returning it to the system. As a result, the suction pressure of the system is increased, and system stability is improved. This increases the efficiency of the system. Certain embodiments of the system will be described below.

According to an embodiment, an apparatus includes a first expander, a flash tank, a first load, a first work recovery compressor, a valve, and a first compressor. The first expander expands a refrigerant. The flash tank stores a refrigerant from the expander. The first load uses the refrigerant from the flash tank to cool a space proximate the first load. The work recovery compressor compresses the refrigerant from the first load and is driven by the first expander. The valve reduces the pressure of the refrigerant from the work recovery compressor below a threshold. The first compressor compresses the refrigerant from the valve.

According to another embodiment, a method includes expanding, by a first expander, a refrigerant and storing, by a flash tank, a refrigerant from the expander. This method also includes using, by a first load, the refrigerant from the flash tank to cool a space proximate to the first load and driving, by the first expander, a work recovery compressor. This method also includes compressing, by the first work recovery compressor, the refrigerant from the first load, reducing, by a valve, a pressure of the refrigerant from the work recovery compressor below a threshold, and compressing, by a first compressor, the refrigerant from the valve.

According to yet another embodiment, a system includes a high side heat exchanger, a first expander, a flash tank, a first load, a first work recovery compressor, a valve, and a first compressor. The high side head exchanger removes heat from a refrigerant. The first expander expands a refrigerant. The flash tank stores a refrigerant from the expander. The first load uses the refrigerant from the flash tank to cool a space proximate to the first load and is driven by the first expander. The valve reduces the pressure of the refrigerant from the work recovery compressor below a threshold. The first compressor compresses the refrigerant from the valve.

Certain embodiments provide one or more technical advantages. For example, an embodiment returns energy back to the system by using energy released during expansion in an expander to drive a work recovery compressor. As a result, the heat in the refrigerant is concentrated, making it easier for the high side heat exchanger to remove. As another example, an embodiment stabilizes the pressure of the refrigerant from the work recovery compressor before returning it to the system, thus increasing a suction pressure and making the system less susceptible to instability caused by the ambient temperature. As a result, the efficiency of the system is increased. Certain embodiments may include none, some, or all of the above technical advantages. One or more other technical advantages may be readily apparent to one skilled in the art from the figures, descriptions, and claims included herein.

BRIEF DESCRIPTION OF THE DRAWINGS

For a more complete understanding of the present disclosure, reference is now made to the following description, taken in conjunction with the accompanying drawings, in which.

DETAILED DESCRIPTION

Embodiments of the present disclosure and its advantages are best understood by referring to FIGS. 1 through 5 of the drawings, like numerals being used for like and corresponding parts of the various drawings.

Refrigeration systems cycle refrigerant to cool spaces, such as residential dwellings, commercial buildings, and/or refrigeration units. Typical refrigeration systems include flash tanks, loads, compressors and a high side heat exchanger. The flash tank stores refrigerant, which is first cycled through the loads. The loads use the refrigerant to cool a space proximate the loads by absorbing heat. Thus, the refrigerant leaving the loads is warmer than the refrigerant entering the loads. The refrigerant is then directed to the compressors. The compressors compress the refrigerant to concentrate the absorbed heat so that the high side heat exchanger can more easily remove the heat from the refrigerant. The refrigerant next cycles through the high side heat exchanger, which removes heat from the refrigerant. From the high side heat exchanger, the refrigerant cycles back to the flash tank, and the cycle begins again. Some commercial refrigeration systems also include an expander that receives refrigerant from the high side heat exchanger before directing the refrigerant to the flash tank. In these systems, the expander further cools the refrigerant though expansion, so the refrigerant is colder when it reaches the loads. During expansion, the refrigerant releases energy. These systems, however, are unable to use the energy released during expansion. Thus, the energy is simply lost. On the other hand, some systems use the energy released during expansion to drive a work recovery compressor that compresses the refrigerant coming from one or more loads before it reaches the compressors. As a result, the heat that has been absorbed by the refrigerant in the loads is more concentrated and can be more easily removed by the high side heat exchanger. However, this process is unreliable and is dependent on ambient temperature. If the ambient temperature is too high, the pressure of the system can reach dangerous levels.

Figure 1:
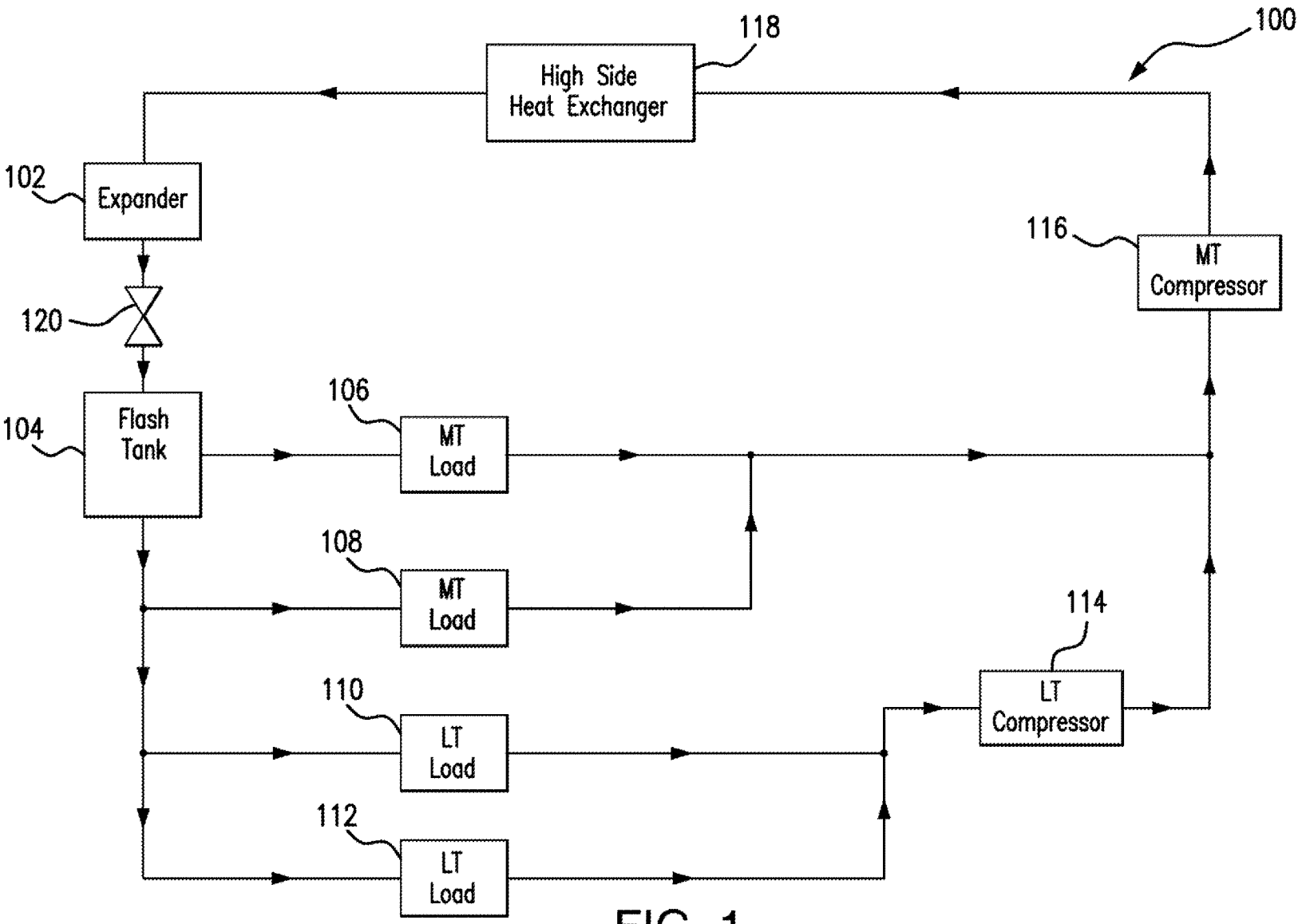
FIG. 1 illustrates an example cooling system.

For example, FIG. 1 illustrates an example cooling system 100. As shown in FIG. 1, system 100 includes a high side heat exchanger 118, a flash tank 104, expansion valve 120, a first medium temperature load 106, a second medium temperature load 108, a first low temperature load 110, a second low temperature load 112, a low temperature compressor 114, and a medium temperature compressor 116. Generally, these components cycle a refrigerant to cool spaces proximate medium temperature load 106, medium temperature load 108, low temperature load 110 and low temperature load 112.

High side heat exchanger 118 removes heat from a refrigerant. When heat is removed from the refrigerant, the refrigerant is cooled. This disclosure contemplates high side heat exchanger 118 being operated as a condenser and/or a gas cooler. When operating as a condenser, high side heat exchanger 118 cools the refrigerant such that the state of the refrigerant changes from a gas to a liquid. When operating as a gas cooler, high side heat exchanger 118 cools gaseous and/or supercritical refrigerant and the refrigerant remains a gas and/or a supercritical fluid. In certain configurations, high side heat exchanger 118 is positioned such that heat removed from the refrigerant may be discharged into the air. For example, high side heat exchanger 118 may be positioned on a rooftop so that heat removed from the refrigerant may be discharged into the air. As another example, high side heat exchanger 118 may be positioned external to a building and/or on the side of a building. Refrigerant passes through expansion valve 120 before reaching flash tank 120. Expansion valve 120 is used to cool refrigerant. Expansion valve reduces the pressure and therefore the temperature of the refrigerant. Expansion valve 120 reduces pressure of the refrigerant flowing into expansion valve 120. The temperature of the refrigerant may then drop as pressure is reduced. As a result, refrigerant entering expansion valve 120 may be cooler when leaving expansion valve 120. The refrigerant leaving expansion valve 120 is fed to flash tank 104.

Flash tank 104 stores refrigerant received from high side heat exchanger 118. This disclosure contemplates flash tank 104 storing refrigerant in any state such as, for example, a liquid state and/or a gaseous state. Refrigerant leaving flash tank 104 is fed to low temperature load 110, low temperature load 112, medium temperature load 106 and medium temperature load 108. In some embodiments, a flash gas and/or a gaseous refrigerant is released from flash tank 104. By releasing flash gas, the pressure within flash tank 104 may be reduced.

System 100 includes a low temperature portion and a medium temperature portion. The low temperature portion typically operates at a lower temperature than the medium temperature portion. In some refrigeration systems, the low temperature portion may be a freezer system and the medium temperature system may be a regular refrigeration system. In a grocery store setting, the low temperature portion may include freezers used to hold frozen foods, and the medium temperature portion may include refrigerated shelves used to hold produce. As seen in FIG. 1, system 100 includes a first medium temperature load 106, a second medium temperature load 108, a first low temperature load 110, and a second low temperature load 112. The medium temperature portion includes first medium temperature load 106 and second medium temperature load 108. The low temperature portion includes first low temperature load 110 and second medium temperature load 112. Each of these loads is used to cool a particular space. For example, first medium temperature load 106 and second medium temperature load 108 may be a produce shelf in a grocery store and first low temperature load 110 and second low temperature load 112 may be a freezer case. Generally, low temperature load 110 keeps a space cooled to freezing temperatures (e.g., below 32 degrees Fahrenheit) and medium temperature load 106 keeps a space cooled above freezing temperatures (e.g., above 32 degrees Fahrenheit).

Refrigerant flows from flash tank 104 to both the low temperature and medium temperature portions of the refrigeration system. For example, the refrigerant may flow to first medium temperature load 106, second medium temperature load 108, first low temperature load 110, and second low temperature load 112. When the refrigerant reaches first medium temperature load 106, second medium temperature load 108, a first low temperature load 110, and second low temperature load 112, the refrigerant removes heat from the air around first medium temperature load 106, second medium temperature load 108, first low temperature load 110, and second low temperature load 112. As a result, the air is cooled. The cooled air may then be circulated such as, for example, by a fan to cool a space such as, for example, a freezer and/or a refrigerated shelf. As refrigerant passes through first medium temperature load 106, second medium temperature load 108, first low temperature load 110, and second low temperature load 112, the refrigerant may change from a liquid state to a gaseous state as it absorbs heat.

Refrigerant flows from first medium temperature load 106, second medium temperature load 108, first low temperature load 110, and second low temperature load 112 to compressors 114 and 116. This disclosure contemplates system 100 including any number of low temperature compressors 114 and medium temperature compressors 116. The low temperature compressor 114 and medium temperature compressor 116 may be configured to increase the pressure of the refrigerant. As a result, the heat in the refrigerant may become concentrated and the refrigerant may become a high-pressure gas. Low temperature compressor 114 compresses refrigerant from first low temperature load 110 and second low temperature load 112 and sends the compressed refrigerant to medium temperature compressor 116. Medium temperature compressor 116 compresses refrigerant from first low temperature compressor 110, second low temperature compressor 112 and/or first medium temperature load 106 and second medium temperature load 108. Medium temperature compressor 116 may then send the compressed refrigerant to high side heat exchanger 118.

A problem occurs in system 100 when expander 102 expands the refrigerant, thus releasing energy. In this instance, the released energy cannot be recycled back into the system. As a result, the efficiency of the system is decreased, and the medium temperature loads and low temperature loads cannot run at the highest pressure, and thus the lowest temperature, available.

This disclosure contemplates an unconventional cooling system that uses the heat released during expansion in expander 102 to drive a work recovery compressor 208. Work recovery compressor 208 compresses refrigerant from a load, thus concentrating the heat within the refrigerant and making it easier for high side heat exchanger 118 to remove the heat. Additionally, this disclosure contemplates using a valve 218 to stabilize the pressure of the refrigerant from the work recovery compressor before returning the recycled energy back to the system, increasing the suction pressure of the system. As a result, first medium temperature load 106 and first low temperature load 110 can be run at the highest the pressure, and thus the lowest temperature, availability and efficiency of the system is increased. Furthermore, the recovery of energy from the expander is less dependent on ambient temperature.

Figure 2:
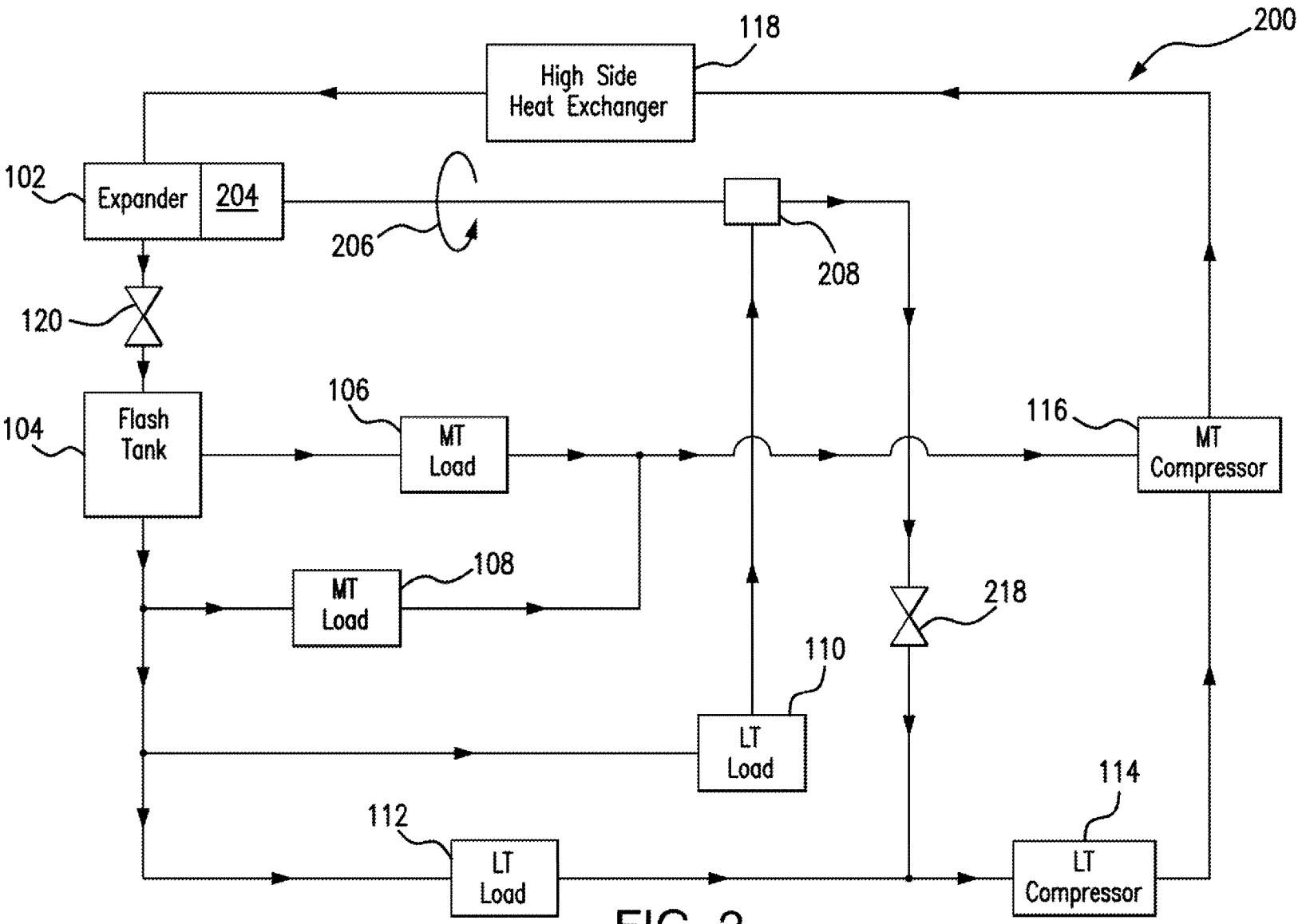
FIG. 2 illustrates an example cooling system.
Figure 3:
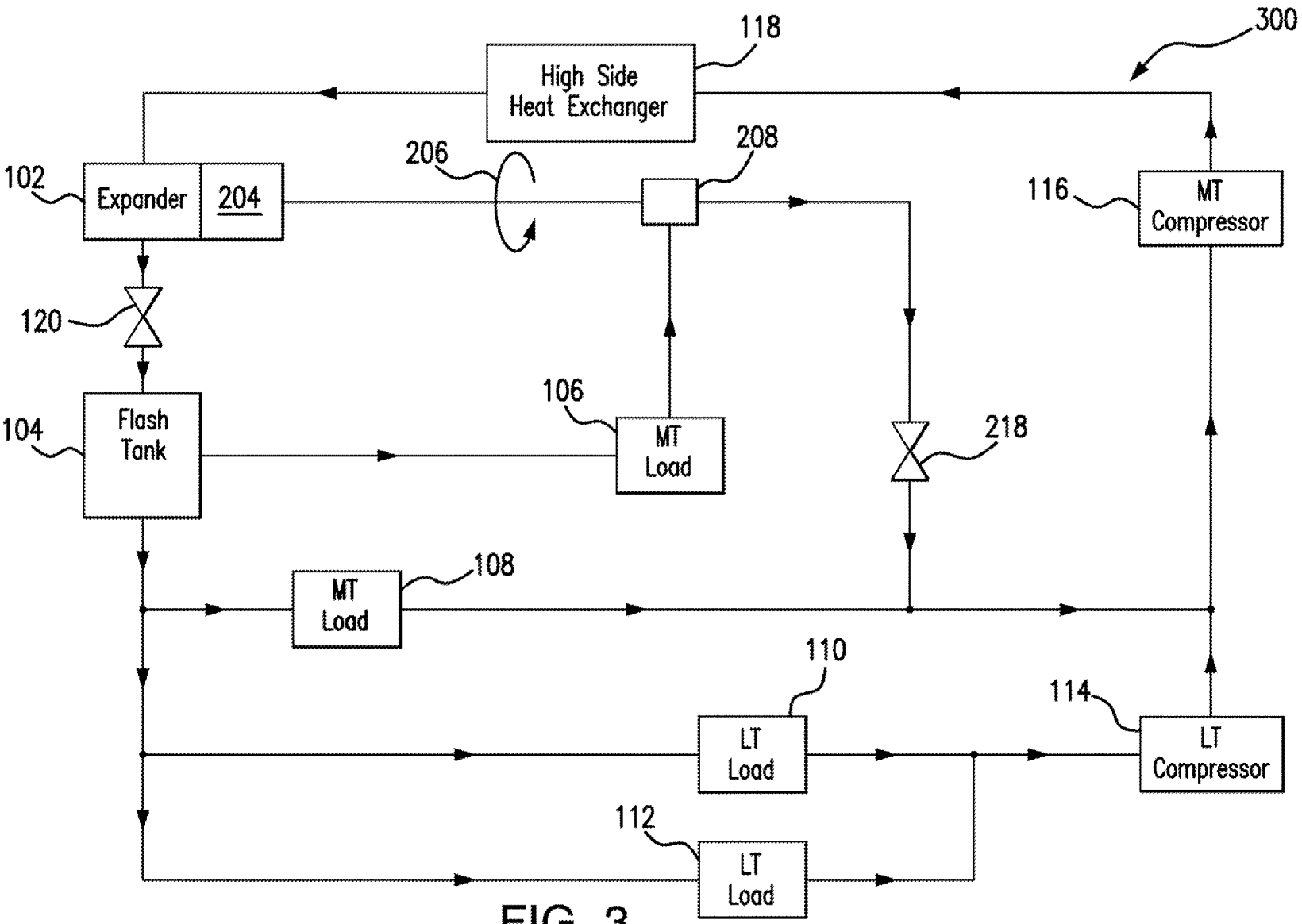
FIG. 3 illustrates an example cooling system.
Figure 4:
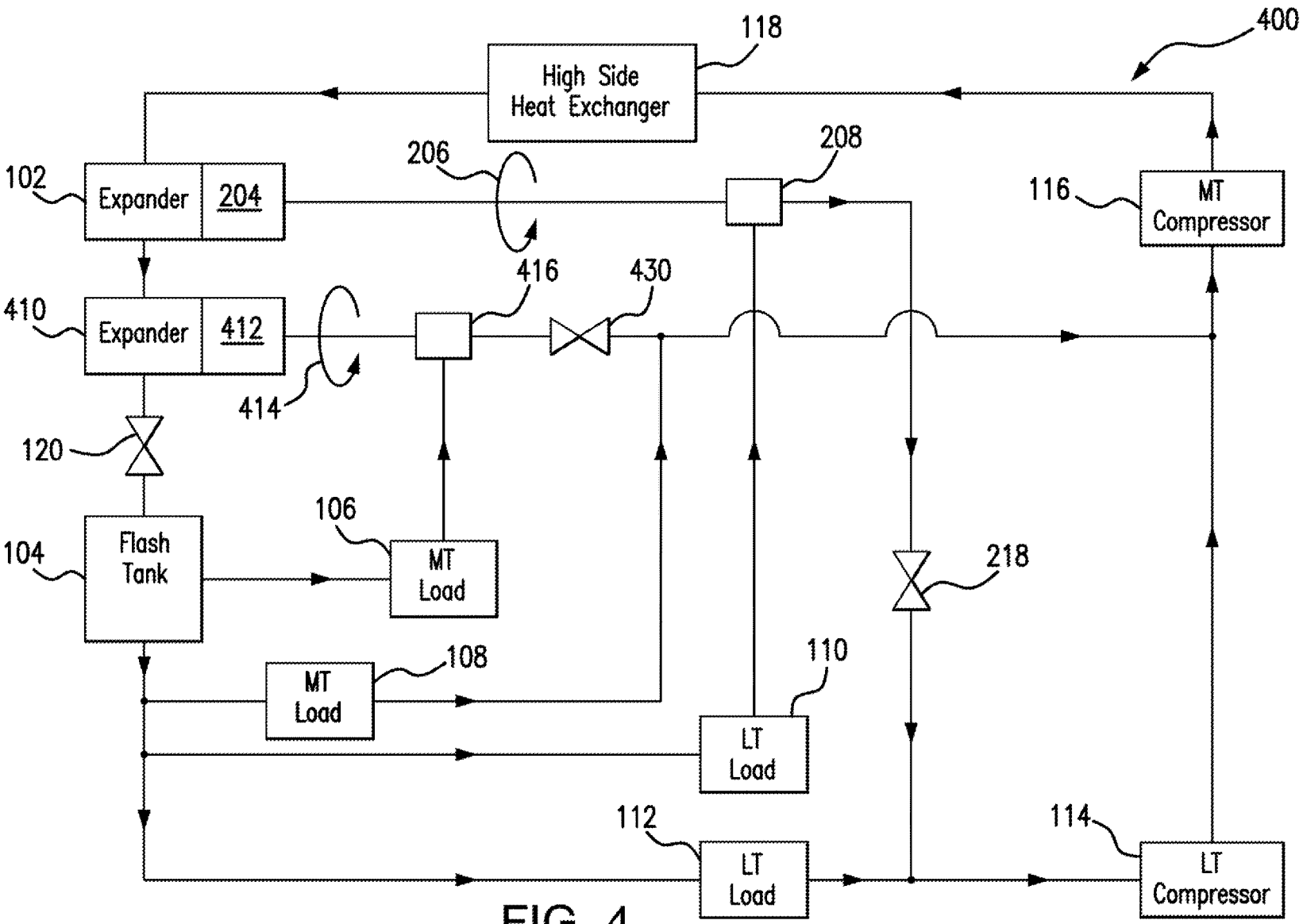
FIG. 4 illustrates an example cooling system.
Figure 5:
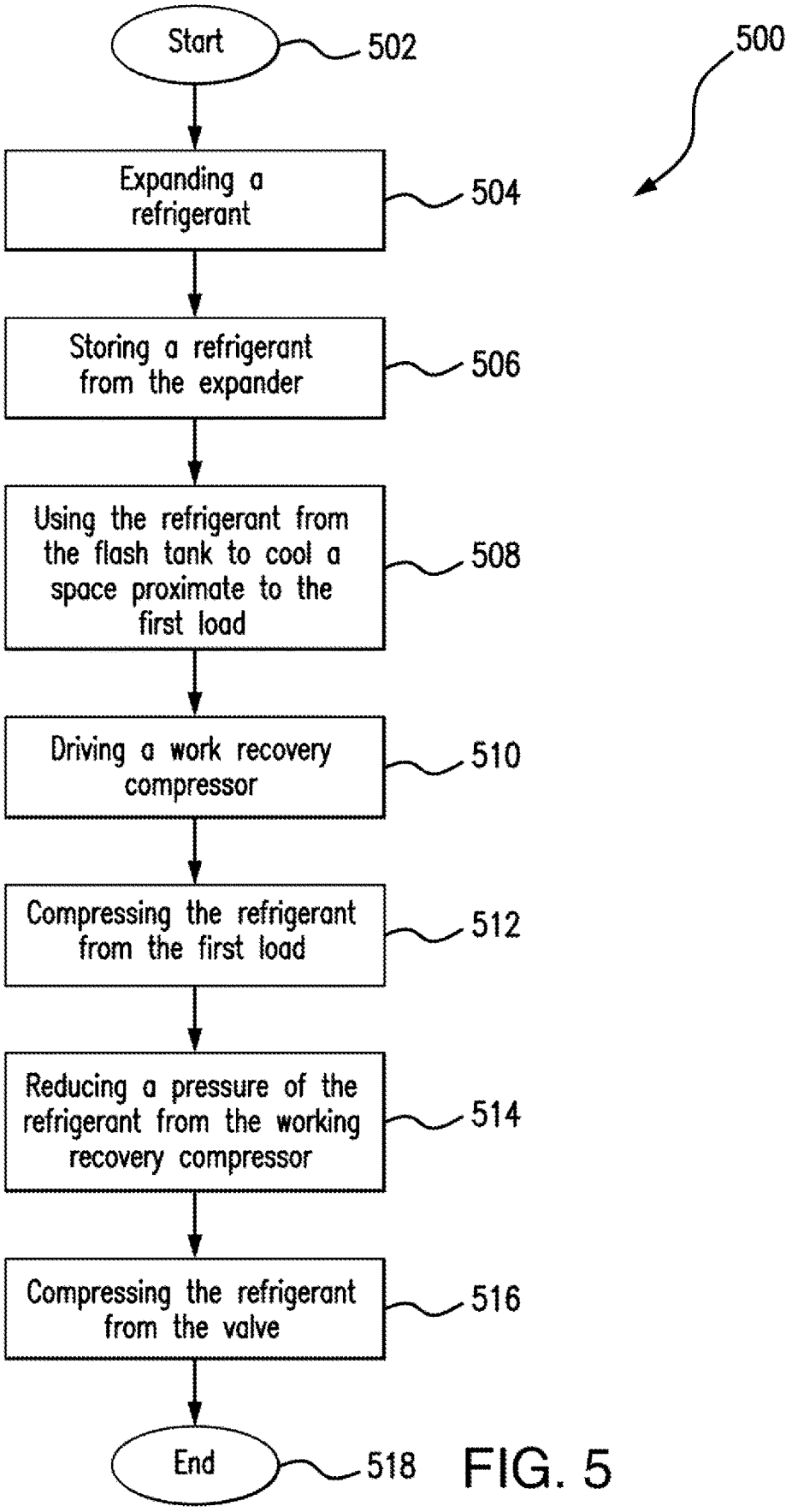
FIG. 5 is a flowchart illustrating a method for operating the cooling system of FIGS. 2-4.

Certain embodiments of the cooling system will be described in more detail using FIGS. 2 through 5. FIGS. 2 through 4 illustrate various designs for the system. FIG. 5 shows a process for operating the system.

FIG. 2 illustrates an example cooling system 200. As seen in FIG. 2, system 200 includes an expander 102, a flash tank 104, expansion valve 120, medium temperature load 106, medium temperate load 108, low temperature load 110, low temperature load 112, low temperature compressor 114, medium temperature compressor 116, high side heat exchanger 118. System 200 also includes connection part 204, shaft 206, work recovery compressor 208, and valve 218. Generally, system 200 allows for energy to be returned back to the system by using energy released during expansion in expander 102 to drive work recovery compressor 208. As a result, the heat in the compressed refrigerant is concentrated, making it easier for high side heat exchanger 118 to remove. Additionally, system 200 allows for the pressure of the refrigerant from work recovery compressor 208 to be stabilized by valve 218 before returning it to the system, thus increasing suction pressure and making the system less susceptible to instability caused by the ambient temperature. As a result, the efficiency of system 200 is increased.

Expander 102, flash tank 104, expansion valve 120, medium temperature load 106, medium temperate load 108, low temperature load 110, low temperature load 112, low temperature compressor 114, medium temperature compressor 116, and high side heat exchanger 118 operate similarly as they did in system 100. For example, expander 102 expands a refrigerant, expansion valve 120 expands and cools a refrigerant, flash tank 104 stores a refrigerant, medium temperature load 106, medium temperature load 108, low temperature load 110, and low temperature load 112 cool particular spaces. Low temperature compressor 114 and medium temperature compressor 116 compress a refrigerant, and high side heat exchanger 118 removes heat from a refrigerant.

In certain embodiments, to improve the efficiency of the system, the energy released during expansion in expander 102 is used to drive work recovery compressor 208. In certain embodiments, expander 102 is configured to use connection part 204 and/or shaft 206 to drive work recovery compressor 208. Connection part 204 may be a gear box. In certain embodiments, connection part 204 is absent and shaft 206 is directly coupled to work recovery compressor 208. Work recovery compressor 208 compresses refrigerant from low temperature load 110, thus concentrating the heat in the refrigerant and making it easier for high side heat exchanger 118 to remove.

After leaving compressor 208, the refrigerant is directed to valve 218. Valve 218 stabilizes the pressure of the refrigerant from work recovery compressor 208, increasing suction pressure and making system 200 less susceptible to instability caused by the ambient temperature. In some embodiments, valve 218 is a pressure-control valve. Valve 218 may increase or decrease the amount of refrigerant that it outputs to maintain a desired pressure value. For example, if the pressure in the system drops below the desired pressure value, valve 218 will open, allowing refrigerant to flow to low temperature compressor 114. Alternatively, if the pressure in the system exceeds a desired pressure value, valve 218 will close, stopping refrigerant from flowing to low temperature compressor 114. In certain embodiments, valve 218 can be opened to various degrees to adjust the amount of flow of refrigerant to low temperature compressor 114. For example, valve 218 may be opened more to increase the flow of refrigerant to low temperature compressor 114. As another example, valve 218 may be opened less to decrease the flow of refrigerant to low temperature compressor 114.

The refrigerant leaving valve 218 combines with the refrigerant from low temperature load 112 and is directed to low temperature compressor 114 where the refrigerant is compressed, concentrating the heat in the refrigerant. The refrigerant leaving low temperature compressor 114 combines with refrigerant from medium load 106 and medium load 108 before reaching medium temperature compressor 116 where the heat in the refrigerant is further concentrated. The refrigerant is then directed to high side heat exchanger 118 where the heat in the refrigerant is removed. As a result of the compression in work recovery compressor 208, high side heat exchanger 118 can more easily remove heat from system 200, increasing the efficiency of system 200.

FIG. 3 illustrates an example cooling system 300. As seen in FIG. 3, system 300 includes an expander 102, expansion valve 120, a flash tank 104, medium temperature load 106, medium temperate load 108, low temperature load 110, low temperature load 112, low temperature compressor 114, medium temperature compressor 116, high side heat exchanger 118, connection part 204, shaft 206, work recovery compressor 208, and valve 218. Generally, system 300 allows for energy to be returned back to the system by using energy released during expansion in expander 102 to drive work recovery compressor 208. As a result, the heat in the refrigerant is concentrated, making it easier for high side heat exchanger 118 to remove. Additionally, system 300 allows for the pressure of the refrigerant from work recovery compressor 208 to be stabilized by valve 218 before returning it to the system, thus increasing suction pressure and making the system less susceptible to instability caused by the ambient temperature. As a result, the efficiency of system 300 is increased.

While the components of system 300 may be like those of system 200, system 300 allows for refrigerant from medium temperature load 106, as opposed to low temperature load 110, to be compressed by work recovery compressor 208, and returns the compressed refrigerant to medium temperature compressor 116, as opposed to low temperature compressor 114. As a result, the suction pressure of medium temperature load 106 is increased and medium temperature load 106 can be run at the lowest temperature possible.

Expander 102, expansion valve 120, flash tank 104, medium temperature load 106, medium temperate load 108, low temperature load 110, low temperature load 112, low temperature compressor 114, medium temperature compressor 116, and high side heat exchanger 118 operate similarly as they did in system 100. For example, expander 102 expands a refrigerant, expansion valve 120 expands and cools a refrigerant, flash tank 104 stores a refrigerant, medium temperature load 106, medium temperature load 108, low temperature load 110, and low temperature load 112 cool particular spaces. Low temperature compressor 114 and medium temperature compressor 116 compress a refrigerant, and high side heat exchanger 118 removes heat from a refrigerant.

In certain embodiments, to improve the efficiency of the system, the energy released during expansion in expander 102 is used to drive work recovery compressor 208. In certain embodiments, expander 102 is configured to use connection part 204 and/or shaft 206 to drive work recovery compressor 208. Work recovery compressor 208 compresses the refrigerant from medium temperature load 106, thus concentrating the heat in the refrigerant and making it easier for high side heat exchanger 118 to remove.

After leaving compressor 208, the refrigerant is directed to valve 218. Valve 218 stabilizes the pressure of the refrigerant from work recovery compressor 208, increasing suction pressure and making system 200 less susceptible to instability caused by the ambient temperature. In some embodiments, valve 218 is a pressure-control valve. Valve 218 may increase or decrease the amount of refrigerant that it outputs to maintain a desired pressure value. For example, if the pressure in the system drops below the desired pressure value, valve 218 will open, allowing refrigerant to flow to medium temperature compressor 116. Alternatively, if the pressure in the system exceeds a desired pressure value, valve 218 will close, stopping refrigerant from flowing to medium temperature compressor 116. In certain embodiments, valve 218 can be opened to various degrees to adjust the amount of flow of refrigerant to medium temperature compressor 116. For example, valve 218 may be opened more to increase the flow of refrigerant to medium temperature compressor 116. As another example, valve 218 may be opened less to decrease the flow of refrigerant to medium temperature compressor 116. The refrigerant leaving valve 218 combines with the refrigerant from medium temperature load 108 and the refrigerant from low temperature compressor 114. The refrigerant is then directed to medium temperature compressor 116 where the heat in the refrigerant is further concentrated. The refrigerant is then directed to high side heat exchanger 118 where the heat in the refrigerant is removed. As a result of the compression in work recovery compressor 208, high side heat exchanger 118 can more easily remove heat from system 300, increasing the efficiency of system 300.

FIG. 4 illustrates an example cooling system 400. As seen in FIG. 4, system 400 includes an expander 102, expansion valve 120, a flash tank 104, medium temperature load 106, medium temperate load 108, low temperature load 110, low temperature load 112, low temperature compressor 114, medium temperature compressor 116, high side heat exchanger 118, connection part 204, shaft 206, work recovery compressor 208, and valve 218. FIG. 4 also includes expander 410, connection part 412, shaft 414, work recovery compressor 416, and valve 430. Generally, system 400 allows for energy to be returned back to the system by using energy released during expansion in expander 102 to drive work recovery compressor 208 and the energy released during expansion in expander 410 to drive work recovery compressor 416. As a result, the heat in the refrigerant is concentrated, making it easier for high side heat exchanger 118 to remove. Additionally, system 400 allows for the pressure of the refrigerant from work recovery compressor 208 to be stabilized by valve 218 and the pressure of the refrigerant from work recovery compressor 416 to be stabilized by valve 430 before returning it to the system, thus increasing suction pressure and making the system less susceptible to instability caused by the ambient temperature. As a result, the efficiency of system 400 is increased.

System 400 contemplates using two work recovery compressors, work recovery compressor 208 and work recovery compressor 416, to compress refrigerant from both low temperature load 110 and medium temperature load 106, respectively. Thus, system 400 allows for the suction pressure of both low temperature load 110 and medium temperature load 106 to be increased, permitting the loads to run at the lowest temperature possible.

Expander 102, expansion valve 120, flash tank 104, medium temperature load 106, medium temperate load 108, low temperature load 110, low temperature load 112, low temperature compressor 114, medium temperature compressor 116, and high side heat exchanger 118 operate similarly as they did in system 100. For example, expander 102 expands a refrigerant, expansion valve expands and cools a refrigerant, flash tank 104 stores a refrigerant, medium temperature load 106, medium temperature load 108, low temperature load 110, and low temperature load 112 cool particular spaces. Low temperature compressor 114 and medium temperature compressor 116 compress a refrigerant, and high side heat exchanger 118 removes heat from a refrigerant. Additionally, connection part 204, shaft 206, work recovery compressor 208, and valve 218 operate similarly as they did in system 200. For example, in certain embodiments, expander 102 uses energy released during expansion to drive work recovery compressor 208. In other embodiments, expander 102 is configured to use connection part 204 and/or shaft 206 to drive work recovery compressor 208. Work recovery compressor 208 compresses refrigerant from low temperature load 110. Valve 218 stabilizes the pressure of the refrigerant from work recovery compressor 218 before directing the refrigerant to low temperature compressor 114. In some embodiments, valve 218 is a pressure-control valve. Valve 218 may increase or decrease the amount of refrigerant that it outputs to maintain a desired pressure value. For example, if the pressure in the system drops below the desired pressure value, valve 218 will open, allowing refrigerant to flow to low temperature compressor 114. Alternatively, if the pressure in the system exceeds a desired pressure value, valve 218 will close, stopping refrigerant from flowing to low temperature compressor 114. In certain embodiments, valve 218 can be opened to various degrees to adjust the amount of flow of refrigerant to low temperature compressor 114. For example, valve 218 may be opened more to increase the flow of refrigerant to low temperature compressor 114. As another example, valve 218 may be opened less to decrease the flow of refrigerant to low temperature compressor 114.

To further improve the efficiency of the system, the energy released during expansion in expander 410 is used to drive work recovery compressor 416. In certain embodiments, expander 410 is configured to use connection part 412 and/or shaft 206 to drive work recovery compressor 416. Work recovery compressor 410 compresses refrigerant from medium temperature load 106, thus concentrating the heat in the refrigerant and making it easier for high side heat exchanger 118 to remove.

After leaving work recovery compressor 416, the refrigerant passes through valve 430. Valve 430 stabilizes the pressure of the refrigerant from work recovery compressor 416, increasing suction pressure and making system 400 less susceptible to instability caused by the ambient temperature. In some embodiments, valve 430 is a pressure-control valve. Valve 430 may increase or decrease the amount of refrigerant that it outputs to maintain a desired pressure value. For example, if the pressure in the system drops below the desired pressure value, valve 430 will open, allowing refrigerant to flow to medium temperature compressor 116. Alternatively, if the pressure in the system exceeds a desired pressure value, valve 430 will close, stopping refrigerant from flowing to medium temperature compressor 116. In certain embodiments, valve 430 can be opened to various degrees to adjust the amount of flow of refrigerant to medium temperature compressor 116. For example, valve 430 may be opened more to increase the flow of refrigerant to medium temperature compressor 116. As another example, valve 430 may be opened less to decrease the flow of refrigerant to medium temperature compressor 116. The refrigerant leaving valve 430 combines with the refrigerant from medium temperature compressor 108 and refrigerant from low temperature compressor 114. The refrigerant is then directed to medium temperature compressor 116. At medium temperature compressor 116, the refrigerant is compressed and the heat in the refrigerant is further concentrated. The refrigerant is then directed to high side heat exchanger 118 where the heat in the refrigerant is removed. As a result of the compression in work recovery compressor 208 and work recovery compressor 416, high side heat exchanger 118 can more easily remove heat from system 400, increasing the efficiency of system 400.

FIG. 5 is a flowchart illustrating a method 500 of operating example cooling system 200, 300, and 400 of FIGS. 2, 3, and 4. In particular embodiments, various components of systems 200, 300, and 400 perform the steps of method 500. By performing method 500, a cooling system returns stable, recycled energy back into the system, thus improving the efficiency of certain components within the system in particular embodiments.

A first expander begins by expanding a refrigerant at step 504. In step 506, a flash tank stores a refrigerant from the expander. A first load uses the refrigerant from the flash tank to cool a space proximate to the first load in step 508. In step 510, the first expander drives a work recovery compressor. The first work recovery compressor compresses a refrigerant from the first load in step 512. In step 514, a valve reduces a pressure of the refrigerant from the work recovery compressor below a threshold. A first compressor compresses a refrigerant from the valve in step 516.

Modifications, additions, or omissions may be made to method 500 depicted in FIG. 5. Method 500 may include more, fewer, or other steps. For example, steps may be performed in parallel or in any suitable order. While discussed as systems 200, 300 or 400 (or components thereof) performing the steps, any suitable component of system 200, 300 or 400 may perform one or more steps of the method.

Modifications, additions, or omissions may be made to the systems and apparatuses described herein without departing from the scope of the disclosure. The components of the systems and apparatuses may be integrated or separated. Moreover, the operations of the systems and apparatuses may be performed by more, fewer, or other components. Additionally, operations of the systems and apparatuses may be performed using any suitable logic comprising software, hardware, and/or other logic. As used in this document, "each" refers to each member of a set or each member of a subset of a set.

Although the present disclosure includes several embodiments, a myriad of changes, variations, alterations, transformations, and modifications may be suggested to one skilled in the art, and it is intended that the present disclosure encompass such changes, variations, alterations, transformations, and modifications as fall within the scope of the appended claims.

What is claimed is:

1. An apparatus comprising:

a first expander configured to expand a refrigerant;

a flash tank configured to store refrigerant from the expander;

a first load configured to use the refrigerant from the flash tank to cool a space proximate the first load;

a first work recovery compressor configured to compress the refrigerant from the first load, the first expander configured to drive the work recovery compressor;

a valve configured to reduce a pressure of the refrigerant received from the first work recovery compressor below a threshold;

a first compressor configured to compress the refrigerant from the valve;

a second expander configured to expand the refrigerant from the first expander;

a second load configured to use the refrigerant from the flash tank to cool a second space proximate the second load;

a second work recovery compressor configured to compress the refrigerant from the second load, the second expander configured to drive the second work recovery compressor; and a second compressor configured to compress the refrigerant from the second work recovery compressor.

2. The apparatus of claim 1, further comprising an expansion valve configured to direct the refrigerant from the expander to the flash tank.

3. The apparatus of claim 1, further comprising a high side heat exchanger configured to remove heat from the refrigerant and to direct the refrigerant to the expander.

4. The apparatus of claim 1, further comprising a connection part coupled to the expander and the work recovery compressor, the expander configured to use the connection part to drive the work recovery compressor.

5. The apparatus of claim 1, further comprising a shaft coupled to the expander and the work recovery compressor, the expander configured to use the shaft to drive the work recovery compressor.

6. The apparatus of claim 1, further comprising a second load configured to use the refrigerant from the flash tank to cool a second space proximate the second load to a temperature greater than the first space, the first compressor configured to compress the refrigerant from the second load.

7. A method comprising:

expanding, by a first expander, a refrigerant;

storing, by a flash tank, refrigerant from the expander;

using, by a first load, the refrigerant from the flash tank to cool a space proximate to the first load;

driving, by the first expander, a work recovery compressor;

compressing, by the first work recovery compressor, the refrigerant from the first load;

reducing, by a valve, a pressure of the refrigerant received from the first work recovery compressor below a threshold;

compressing, by a first compressor, the refrigerant from the valve;

expanding, by a second expander, the refrigerant from the first expander;

using, by a second load, the refrigerant from the flash tank to cool a second space proximate the second load;

driving, by the second expander, the second work recovery compressor;

compressing, by a second work recovery compressor, the refrigerant from the second load; and compressing, by a second compressor, the refrigerant from the second work recovery compressor.

8. The method of claim 7, further comprising directing, by an expansion valve, the refrigerant from the expander to the flash tank.

9. The method of claim 7, further comprising:

removing, by a high side heat exchanger, heat from the refrigerant; and directing, by the high side heat exchanger, the refrigerant to the expander.

10. The method of claim 7, further comprising using, by the expander, a connection part coupled to the expander and the work recovery compressor to drive the work recovery compressor.

11. The method of claim 7, further comprising using, by the expander, a shaft coupled to the expander and work recovery compressor to drive the work recovery compressor.

12. The method of claim 7, further comprising:

using, by a second load, the refrigerant from the flash tank to cool a second space proximate the second load to a temperature greater than the first temperature; and compressing, by the first compressor, the refrigerant from the second load.

13. A system comprising:

a high side heat exchanger configured to remove heat from a refrigerant;

a first expander configured to expand the refrigerant;

a flash tank configured to store refrigerant from the expander;

a first load configured to use the refrigerant from the flash tank to cool a space proximate the first load;

a first work recovery compressor configured to compress the refrigerant from the first load, the first expander configured to drive the work recovery compressor;

a valve configured to reduce a pressure of the refrigerant received from the first work recovery compressor below a threshold;

a first compressor configured to compress the refrigerant from the valve;

a second expander configured to expand the refrigerant from the first expander;

a second load configured to use the refrigerant from the flash tank to cool a second space proximate the second load;

a second work recovery compressor configured to compress the refrigerant from the second load, the second expander configured to drive the second work recovery compressor; and a second compressor configured to compress the refrigerant from the second work recovery compressor.

14. The system of claim 13, further comprising an expansion valve configured to direct refrigerant from the expander to the flash tank.

15. The system of claim 13, further comprising a connection part coupled to the expander and the work recovery compressor, the expander configured to use the connection part to drive the work recovery compressor.

16. The system of claim 13, further comprising a shaft coupled to the expander and the work recovery compressor, the expander configured to use the shaft to drive the work recovery compressor.

17. The system of claim 13, further comprising a second load configured to use the refrigerant from the flash tank to cool a second space proximate the second load to a temperature greater than the first space, the first compressor configured to compress the refrigerant from the second load.

* * * * *